US005398424A

United States Patent [19]

Corcoran

[11] Patent Number: 5,398,424

[45] Date of Patent: Mar. 21, 1995

[54] TOWEL HAVING A PROTECTIVE COVERING FOR USE IN WET WEATHER

[76] Inventor: Jerry A. Corcoran, 1586 N. Redwood, Canby, Oreg. 97013

[21] Appl. No.: 951,165

[22] Filed: Sep. 25, 1992

[51] Int. Cl.[6] ..... F26B 13/26

[52] U.S. Cl. ..... 34/95; 150/160

[58] Field of Search ..... 34/95, 89.1, 9, 14, 34/69, 71, 329, 335, 355, 397; 150/159, 160, 161; 206/315.4

[56] References Cited

U.S. PATENT DOCUMENTS

| | | | |
|---|---|---|---|
| 3,023,795 | 3/1962 | Denkert | 150/160 |
| 3,303,865 | 2/1967 | Ouimet | 150/160 |
| 3,406,419 | 10/1968 | Young | 150/160 |
| 3,965,955 | 6/1976 | Price | 150/160 |
| 4,498,579 | 2/1985 | Brick | 150/159 |
| 4,662,415 | 5/1987 | Proutt | 150/160 |
| 4,667,716 | 5/1987 | Solheim et al. | 150/160 |
| 4,898,222 | 2/1990 | Gaffney | 150/160 |
| 5,009,327 | 4/1991 | Levison | 220/890 |
| 5,099,897 | 3/1992 | Curtin | 150/159 |
| 5,146,968 | 9/1992 | Meek | 150/160 |
| 5,203,390 | 4/1993 | Eckstein | 150/160 |
| 5,215,136 | 6/1993 | Flanders et al. | 150/160 |

*Primary Examiner*—Denise L. Gromada
*Attorney, Agent, or Firm*—Edward B. Watters

[57] ABSTRACT

A hand-held rain towel suitable for cleaning and drying golf clubs and other implements in wet weather. A towel folded in an elongate configuration and provided with a pliable rainproof cover defines a pocket open on one side and at the bottom, which receives an object such as a golf-club handle, wipes water droplets off the object, and then absorbs residual moisture from the handle in the folds of the towel.

9 Claims, 1 Drawing Sheet

TOWEL HAVING A PROTECTIVE COVERING FOR USE IN WET WEATHER

BACKGROUND OF THE INVENTION

This invention relates to a hand-held dryer cloth for cleaning and drying implements, and particularly to an accessory towel to be carried and used outdoors in rainy weather.

Dryer towels carried and used outdoors for drying hands and for cleaning and drying implements become quickly sodden and ineffective for their intended use in wet, rainy weather. Towels stored inside waterproof containers are known, however such stored towels are usually collapsed into a tightly packed configuration for storage, and it is inconvenient to remove the towel from the container and unfurl it to make it ready for use.

Accordingly, it is a primary object of the invention to provide an improved weatherproof dryer towel;

It is another object of the invention to provide an improved hand-held dryer towel having a water impervious cover for use outdoors in wet or rainy weather.

Another object of the invention is to provide an improved dryer towel that is protected from the weather while remaining ready for use.

It is a further object of the instant invention to provide an improved dryer towel that wipes excess water from an object as it is being inserted into the towel for drying, prior to the towel absorbing residual moisture from the object.

SUMMARY OF THE INVENTION

According to the invention, I provide a weatherproof hand-held dryer for drying objects outdoors in precipitative weather. The dryer incorporates a towel folded to form a pocket with an opening receiving the object to be dried in folds of the towel, and a fabric sheath, which is impervious to water, that envelopes the folded towel and is attached to it along one edge.

The fabric sheath enfolds margins of the towel along the opening and extends inside the pocket, whereby the object inserted into the opening is first wiped by the fabric sheath and then dried by the folds of the towel.

BRIEF DESCRIPTION OF THE DRAWINGS

While the invention is set forth with particularity in the appended claims, other objects, features, advantages and the construction of the invention will become more apparent, and the invention will best be understood by referring to the following detailed description in conjunction with the accompanying drawing in which:

Figure 4:
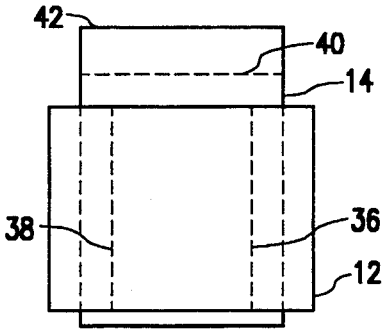
FIGS. 3–6 illustrate successive steps in the assembly and construct on of the dryer towel of FIG. 1.
Figure 3:
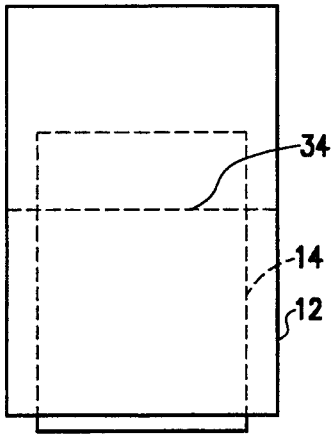

Dashed lines in the drawing indicate hidden features according to convention, and fold lines where specified, while lines having dashes alternating with dots represent visible stitching.

DESCRIPTION OF THE PREFERRED EMBODIMENT

Figure 2:
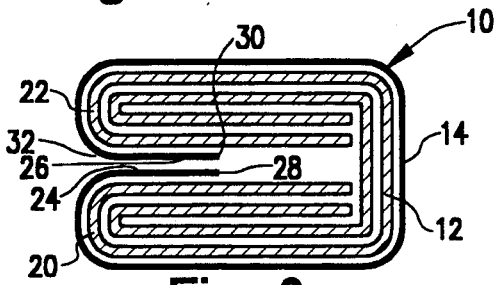
FIG. 2 is a section view taken along lines 2—2 of FIG. 1.
Figure 1:
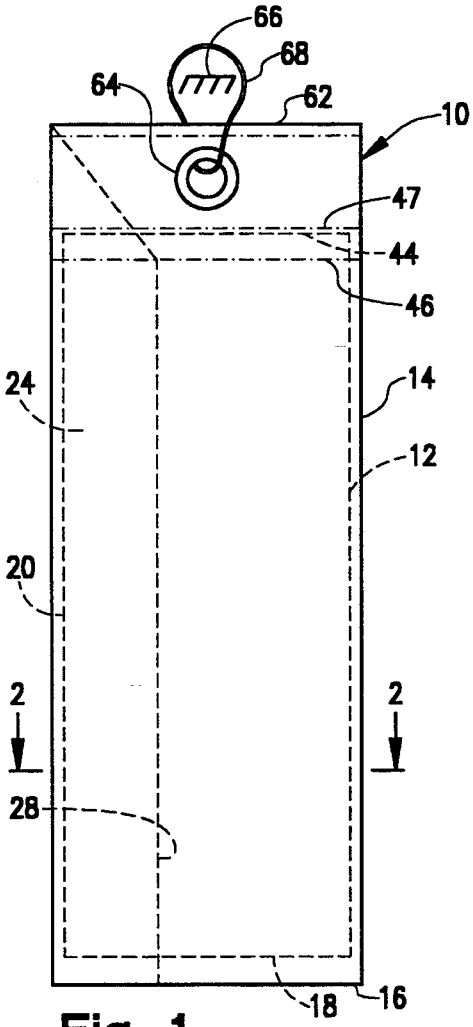
FIG. 1 is a front elevational view of a dryer towel with a protective covering in accordance with the invention.

Referring now to the various views of the drawing for a more detailed description of the components, materials, construction, function, operation and other features of the invention by characters of reference, and in which like characters denote like elements throughout the several views, FIGS. 1 and 2 illustrate a rain towel 10 comprising a towel 12 of terry or a similar absorbent fabric, folded upon itself and disposed within and surrounded by a covering 14, which protects the towel from the elements. The covering 14 is suitably made of nylon fabric or other material impervious to rain. Fabrics impervious to the passage of water but not impervious to the passage of air are particularly efficacious and suitable for the covering 14.

The thickness of the rain towel 10 is exaggerated in FIG. 2 to illustrate the folded arrangement of the towel 12 and its covering 14, and while the various layers illustrated in FIG. 2 are shown as spaced apart, it is understood that in the actual device the folded layers contact adjacent layers of fabric.

Lower edge 16 of the covering 14 extends slightly below the lower end 18 of the towel 12, and the sides of the protective covering 14 enfold juxtaposed margins 20, 22 of the towel 12 to define internally disposed panels 24, 26 wherein respective vertical edges 28, 30 of the covering 14 extend inside the folds of the towel a substantial distance, about one-third the lateral dimension of the rain towel 10.

The folded rain towel 10 forms an elongate pocket having an opening 32 extending longitudinally from top to bottom along one side of the towel 10, into which an implement such as the handle of a golf club (not shown) can be inserted. When the handle is inserted into the elongate opening 32, water droplets are wiped therefrom by the juxtaposed panels 24, 26 as the implement passes between them, then moisture remaining on the handle is absorbed by the towel as the handle moves further into the pocket past the panels 24, 26. The implement is conveniently removed from inside the towel by slipping it longitudinally out the open bottom.

Referring now to FIGS. 3–6, FIG. 3 illustrates the towel 12, unfolded and overlaying the flat protective covering 14. The towel 12 is suitably of a standard size, being in the presently described embodiment 66 centimeters (26 inches) long and 40.5 centimeters (16 inches) wide. The cover 14 is suitably 48 centimeters ($18\frac{7}{8}$ inches) long and 35 centimeters ($13\frac{3}{4}$ inches) wide, prior to hemming. The towel is first folded on horizontal fold line 34 to form the structure illustrated in FIG. 4.

Figure 5:
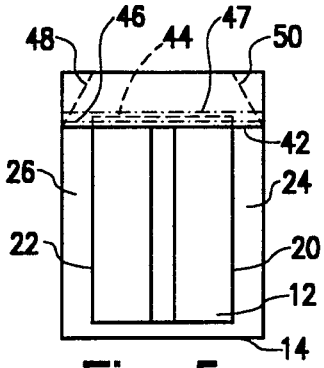

Referring to FIGS. 4 and 5, the bifold towel 12 of FIG. 4 is further folded on vertical fold lines 36, 38 in a trifold configuration to form the respective right- and left-hand margins 20, 22 as illustrated in FIGS. 5 and 2. The cover 14 is then folded on horizontal fold line 40, (FIG. 4), edge 42 of the cover overlapping the top margin 44 of the towel 12, and the cover 14 is stitched to the layered towel 12 along a stitch line 46. A second stitch line 47 above the top margin 44 of the towel holds the overlapped panels of the cover 14 securely fastened together.

Figure 6:
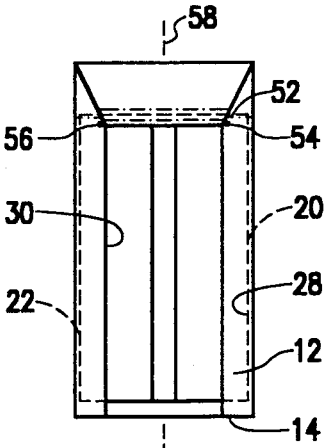

Referring to FIGS. 5 and 6, upper corners of the folded cover are inwardly folded along diagonal fold lines 48, 50 and stitched in place, as illustrated in FIG. 6 by stitch line 52. The panels 24, 26 of the cover 12 are then folded around the respective margins 20, 22 of the folded towel and tacked in place at corners 54.

Referring now to FIGS. 6, 1 and 2, the entire assembly of the folded towel 12 and cover 14 (FIG. 6) is then folded on vertical fold line 58 to form the rain towel substantially as illustrated in FIGS. 1 and 2. The folded cover 14 is stitched along stitch line 60 at the top edge 62 of the cover, holding the towel with its protective sheath together to form a pocket or pouch closed at the top and protected from rain, but open along one side for receiving an implement to be dried within the folds of the towel. The stitching can be sealed against ingress of rain with a suitable sealant such as silicone rubber; however, I have found that even with a tight stitch, four to five stitches per centimeter, a negligible amount of moisture is absorbed by the towel through the stitching, over a normal period of use, ninety minutes, in a gentle rain. Alternatively, the described attachments can be effected by bonding the fabrics with a suitable adhesive, by fasteners such as rivets, or by a combination of these methods.

A suitable attachment means such as a grommet 64 is provided for attaching or hanging the assembled towel 10 to a carrier (represented by symbol 66) which can be a belt, cart, golf bag or the like, as with a loop 68, a hook or a length of cord. Alternatively, the towel can be attached to a carrier, whether a person or an object, by hook-and-loop fastening members, or by one or more belt loops sewn or bonded to the top panel of the cover.

While the rain towel is described herein as having multiple folds, which is the best-mode embodiment, it is understood that other arrangements can be utilized. For example, instead of the bifold/trifold configuration described, the towel can be assembled with a vertically oriented bifold arrangement only, or with only the trifold configuration.

The towel can be carried conveniently by an official during a game played outdoors in the rain, football for example, and by virtue of its being open at its lower end 18, the towel 12 is readily available and can be partially unfolded for drying the hands. Moreover, the rain towel being soft and pliable will not cause injury to a person falling upon it or otherwise struck by the towel, as might occur with a towel carried in a rigid container. Its use is not limited to sporting activities; the rain towel can be carried by anyone who might be required to work in precipitative weather, for example, photographers, journalists, longshoremen, construction workers (for drying hand tools), etc.

When the rain towel is used to clean and dry dirty objects, for example golf balls and the heads of golf clubs, and thereby becomes soiled, the soiled towel with its attached protective cover is easily cleaned in an automatic washing machine.

While the principles of my invention have now been made clear in the foregoing illustrative embodiment, there will be immediately obvious to those skilled in the art many modifications of structure, arrangement, proportions, the elements, material and components used in the practice of the invention, and otherwise, which are particularly adapted for specific environments and operating requirements without departing from those principles. The appended claims are, therefore, intended to cover and embrace any such modifications, within the limits only of the true spirit and scope of the invention.

I claim:

1. A weatherproof hand-held dryer for drying objects used in precipitative weather, comprising:

a folded towel; and a pliable fabric sheath attached to the folded towel, the pliable fabric sheath being impervious to water and enveloping the folded towel to protect the towel from precipitative weather, the sheath and the folded towel forming a substantially rectangular pocket with a top margin, a bottom margin and opposite longitudinal side margins, the pocket having an opening extending along the bottom margin and one of the longitudinal side margins, the pocket being adapted to receive an object to be dried through the opening, the fabric sheath enveloping marginal edges of the folded towel along the one longitudinal side margin of the opening and extending a substantial distance inside the pocket forming panels of the fabric sheath, the panels first wiping water droplets from the object inserted into the opening, residual moisture on the object then being dried by the folds of the towel as the object moves past the panels and into the pocket.

2. The dryer according to claim 1 wherein the fabric sheath and the folded towel are attached to each other along the top margin of the pocket.

3. The dryer according to claim 2 comprising means for attaching the dryer to a carrier.

4. The dryer according to claim 1 wherein the pliable fabric sheath is attached to the folded towel along only one margin of the folded towel.

5. A weatherproof hand-held dryer for drying objects used in precipitative weather, comprising:

a folded towel; and a pliable fabric sheath attached to the folded towel, the pliable fabric sheath being impervious to water end enveloping the folded towel to protect the towel from precipitative weather, the sheath and the folded towel forming a substantially rectangular pocket with a top margin, a bottom margin and opposite longitudinal side margins, the pocket having an opening extending along the bottom margin and one of the longitudinal side margins, the pocket being adapted to receive an object through the opening to be dried in folds of the towel disposed internally of the fabric sheath, the towel being folded in a trifold configuration forming at least four layers of toweling, a first margin of the folded towel being disposed opposite the opening and internally of the pocket along the longitudinal side margin of the pocket opposite the one longitudinal side margin, edges of the folded towel being internally disposed in the pocket adjacent the first margin, the trifold configuration further forming second and third juxtaposed margins of the folded towel at the opening along the one longitudinal side margin, the fabric sheath enfolding each of the second and third juxtaposed margins of the towel and extending inside the pocket forming panels of the fabric sheath for first wiping water from the object inserted into the opening, the object then being dried by the folds of the towel as the object moves past the panels and into the pocket.

6. A Weatherproof hand-held dryer for drying objects used in precipitative weather, comprising:

a rectangular towel folded with juxtaposed edges of the towel defining an opening along a side margin of the folded towel opposite a closed margin at a fold, the folded towel having top and bottom margins; and a protective cover of fabric impervious to water, the protective cover enveloping the folded towel and attached to the folded towel along its top margin, a top edge of the protective cover being folded on itself and joined together to enclose the top margin of the folded towel, the protective cover enfolding the juxtaposed edges of the towel to define panels extending partially inside the opening, the panels first wiping water off a wet object inserted into the opening, residual moisture then being dried from the object by the folds of the towel as the object moves past the panels and into the folds of the towel.

7. The dryer according to claim 6 comprising means for attaching the dryer to a carrier.

8. A weatherproof hand-held dryer for drying objects used in precipitative weather; comprising:

a folded towel; and a pliable fabric sheath attached to the folded towel, the pliable fabric sheath being impervious to water and enveloping the folded towel to protect the towel from precipitative weather, the sheath and the folded towel forming a substantially rectangular pocket with a top margin, a bottom margin and opposite longitudinal side margins, the pocket having an opening extending along the bottom margin and one of the longitudinal side margins, the pocket being adapted to receive an object through the opening to be dried in folds the towel disposed internally of the fabric sheath, the towel being folded in a bifold/trifold configuration forming eight layers of toweling, a top margin of the folded towel being defined by a bifold fold line (34), the pliable fabric sheath and the top margin of the folded towel being attached to each other along the top margin of the pocket, a first longitudinal margin of the folded towel disposed internally of the pocket along a fold line (58) opposite the opening (32) and along the longitudinal side margin opposite the one longitudinal side margin, edges of the folded towel being internally disposed in the pocket adjacent the first margin, the bifold/trifold configuration further forming second (20) and third (22) juxtaposed margins of the folded towel at the opening (32) along the one longitudinal side margin of the pocket, the fabric sheath enfolding each of the second and third juxtaposed margins of the towel and extending (28) (30) a substantial distance inside the pocket for first wiping water off the wet object inserted into the opening, residual moisture then being dried from the object by the layers of toweling when the object moves past the panels and into the pocket.

9. The dryer according to claim 8 wherein the pliable fabric sheath is attached to the folded towel along only the top margin of the pocket.

* * * * *